United States Patent [19]

Almasi et al.

[11] 4,336,799

[45] Jun. 29, 1982

[54] APPARATUS FOR SUPPLYING OXYGEN TO A USER

[75] Inventors: Istvan Almasi; Ferenc Kassai; Attila Erdelyi, all of Budapest, Hungary

[73] Assignee: Banyaszati Aknamelyito Vallalat, Budapest, Hungary

[21] Appl. No.: 183,933

[22] Filed: Sep. 3, 1980

[51] Int. Cl.[3] ..... A62B 18/04

[52] U.S. Cl. ..... 128/201.24; 128/201.28; 128/201.25

[58] Field of Search ..... 128/201.22, 201.23, 128/201.24, 201.25, 201.26, 201.27, 201.28, 204.26, 205.12, 205.18, 205.21, 205.22, 205.24, 205.25

[56] References Cited

U.S. PATENT DOCUMENTS

| | | | |
|---|---|---|---|
| 3,018,790 | 1/1962 | Kimes | 128/204.26 |
| 3,073,301 | 1/1963 | Hay et al. | 128/205.25 |
| 3,620,213 | 11/1971 | Savoie, Jr. | 128/201.25 |
| 3,910,269 | 10/1975 | Ansite et al. | 128/201.24 |
| 4,227,520 | 10/1980 | Lord | 128/201.25 |

FOREIGN PATENT DOCUMENTS

| | | | |
|---|---|---|---|
| 665248 | 9/1938 | Fed. Rep. of Germany | 128/205.24 |
| 1193814 | 5/1965 | Fed. Rep. of Germany | 128/205.25 |
| 491609 | 9/1938 | United Kingdom | 128/201.24 |
| 791010 | 2/1958 | United Kingdom | 128/205.24 |

*Primary Examiner*—Henry J. Recla
*Attorney, Agent, or Firm*—Karl F. Ross

[57] ABSTRACT

An apparatus for supplying oxygen to a person at a mine site upon the depletion of atmospheric oxygen or the filling of the air with smoke or dust particles or poisonous fumes comprising a helmet having a visor shiftably mounted thereon for normally assuming an out-of-use position and for assuming an in-use position over the face of a user upon manipulation thereby. An oxygen-containing vessel is attached to a belt worn by the user, with a conduit connected at one end to the vessel and at the other end to the visor for forming a gas-guiding channel between the vessel and a space formed between the face of the user and the visor upon a shifting thereof into the in-use position. A gas-flow control on the vessel for enabling communication between the vessel and the conduit includes a narrow gas-conducting duct and a broad gas-conducting duct, the gas-flow control further including an initialization valve normally blocking the broad duct and an actuator operatively connectable to the valve for temporarily unblocking the broad duct upon a shifting of the visor into the in-use position, a tension member extending through the conduit along the length thereof from the visor to the gas-flow control for actuating same.

11 Claims, 8 Drawing Figures

APPARATUS FOR SUPPLYING OXYGEN TO A USER

FIELD OF THE INVENTION

Our present invention relates to an apparatus for supplying oxygen to a user. More particularly, our present invention relates to an apparatus wearable by a user at a work area such as a mine site where there is a danger of atmosphere contamination detrimental to the health of the user, the apparatus being operable by the user to supply oxygen to him.

BACKGROUND OF THE INVENTION

In work areas such as mines a danger of atmosphere contamination detrimental to workers' well-being is always present. A fire may deplete the air of oxygen and fill the work area with smoke particles which interrupt regular breathing processes. Oxygen may also be removed by the sudden and voluminous incursion of a foreign gas into the work area from newly opened fissures in the walls of the mine. Other dangers to personnel include the leaking of poisonous fumes into the air and a heavy loading of the atmosphere with dust particles, e.g. upon a cave-in.

Generally, oxygen-supplying devices for application upon the occurrence of such an incipiently disastrous event are too heavy and bulky to be continually worn or carried by personnel working at a mine site. Such devices are usually placed by the individual workmen on the ground at distances of ten to twenty meters from the site of the actual mining operations. The devices include eye glasses, nose clamps, mouthpieces connected to hoses extending from oxygen tanks, and valves for permitting oxygen flow from the tanks to the mouthpieces.

The disadvantages of using such oxygen-rescue devices is the relatively long time required to set the devices into operation. The manipulations of the nose clamps, the mouthpieces, the tanks and the valves may be complex and extensive. In addition, there is the time necessary to reach the devices from the mining site. Smoke and dust particles may inhibit vision, increasing the time it takes to locate the breathing apparatuses and thereby incrementing the probability of casualty. Uncertainty as to the location of the devices and as to the time available for application thereof induces panic which further aggravates the situation.

Another kind of breathing apparatus is known in which a blower or fan forces air from the atmosphere through a filter and into a space between a visor and the face of a user, the filtered air together with exhalations of the user leaving this space via an opening or gap between the bottom of the visor and the chin or the neck of the user. The outflow of air prevents the entry of poisonous or noxious fumes through the gap into the spacer at the user's face.

A disadvantage of such a breathing device is that it is ineffective in cases involving a depletion of atmosphere oxygen, e.g. owing to a fire or voluminous gaseous incursion. The fan and filter only remove noxious components from the air and are unable to supply oxygen in the event of a lack thereof.

OBJECTS OF THE INVENTION

An object of our present invention is to provide an oxygen-supplying apparatus of the above-mentioned type, in which the time required for setting the apparatus into operation or for applying the apparatus is minimized.

Another object of our present invention is to provide such an apparatus which is capable of being continuously worn by the user without interfering in his work.

A more particular object of our present invention is to provide such a device which requires a minimum of manipulations to initiate operation.

SUMMARY OF THE INVENTION

An apparatus for supplying oxygen to a user comprises, according to our present invention, a visor shiftably mounted on a helmet for normally assuming an out-of-use position removed from the face of the user and for assuming an in-use position over the face of the user upon a manipulation thereby. A conduit is connected at one end to an oxygen-containing vessel attachable to a belt worn by the user and at another end to the visor for forming a gas-guiding channel between the vessel and a space formed between the face of the user and the visor upon a shifting thereof into the in-use position. A gas-flow control is provided on the vessel for enabling communicating between the vessel and the conduit, while a force-transmitting member extends from the visor to the gas-flow control for actuating same to connect the vessel to the conduit upon a shifting of the visor into the in-use position.

According to another feature of our present invention, a seal is provided on the visor for engaging in a substantially air-tight fit the face of the user upon a shifting of the visor into the in-use position, whereby an enclosed space is formed at the face of the user. A pressure-regulator is further provided on the visor for controlling the pressure of gas admitted into the enclosed space from the vessel via the conduit.

The pressure-regulator preferably includes a first pressure-relief valve connected to the conduit for admitting oxygen-containing gas into the enclosed space upon an exceeding of a predetermined limit by the pressure difference between gas in the conduit and gas in the enclosed space. A second pressure-relief valve is disposed on the visor between the atmosphere and the enclosed space for venting excess gas therefrom.

According to another feature of our present invention, a sack is linked to the visor for communicating with the enclosed space to receive and temporarily store gas therefrom, the sack being connected to a filter for eliminating noxious components from the gases in the enclosed space.

According to yet another feature of our present invention, the conduit is partially in the form of a flexible hose attached to the vessel via the gas-flow control and partially in the form of a telescoping tube extending to the visor from a helmet mount also connected to the flexible hose. The force-transmitting member advantageously includes a tension member such as a cable extending through the hose along the length thereof, an adjuster being tied to the tension member to adjust the effective length thereof.

Pursuant to more particular features of our present invention, the gas-flow control includes first means for conveying oxygen-containing gas from the vessel to the enclosed space at a relatively slow rate during a steady-state operation of the breathing or oxygen-supplying apparatus and second means for conveying gas from the vessel to the enclosed space at a relatively high rate during a transient state or phase involving an initial charging of the enclosed space upon a shifting of the visor from the out-of-use position to the in-use position. The first means advantageously includes a narrow gas-conducting or gas-channeling duct and the second means a broad gas-conducting duct, while the gas-flow control includes an initialization valve normally blocking the broad duct and an actuator operatively connectable to this valve for temporarily unblocking the broad duct upon a shifting of the visor into the in-use position. More particularly, the gas-flow control includes a shaft connected to the tension member and the actuator includes a pivotably mounted lever linked to the shaft for swinging into an engagement with the initialization valve upon a loading of the tension member.

Pursuant to yet another feature of our present invention, the gas-flow control includes a valve member rigid with the shaft and seated in a valve housing in an out-of-use state of the apparatus corresponding to the out-of-use position of the visor, the gas-flow control further including a spring-loaded latch mounted in the housing. The shaft is biased by a spring in a direction tending to seat the valve member and thereby block a gas-flow channel to the conduit from the vessel and is provided with means for forming a locked engagement with the latch in an in-use state of the apparatus corresponding to the in-use position of the visor.

An oxygen-supplying apparatus according to our present invention may be continuously worn by the user and requires only one manipulation to be set into operation. Oxygen may be supplied within seconds upon the perception of a dangerous condition in the atmosphere.

BRIEF DESCRIPTION OF THE DRAWING

These and other features and advantages of an oxygen-supplying apparatus according to our present invention will now be described in detail, reference being made to the accompanying drawing in which.

SPECIFIC DESCRIPTION

Figures 1A, 1B:
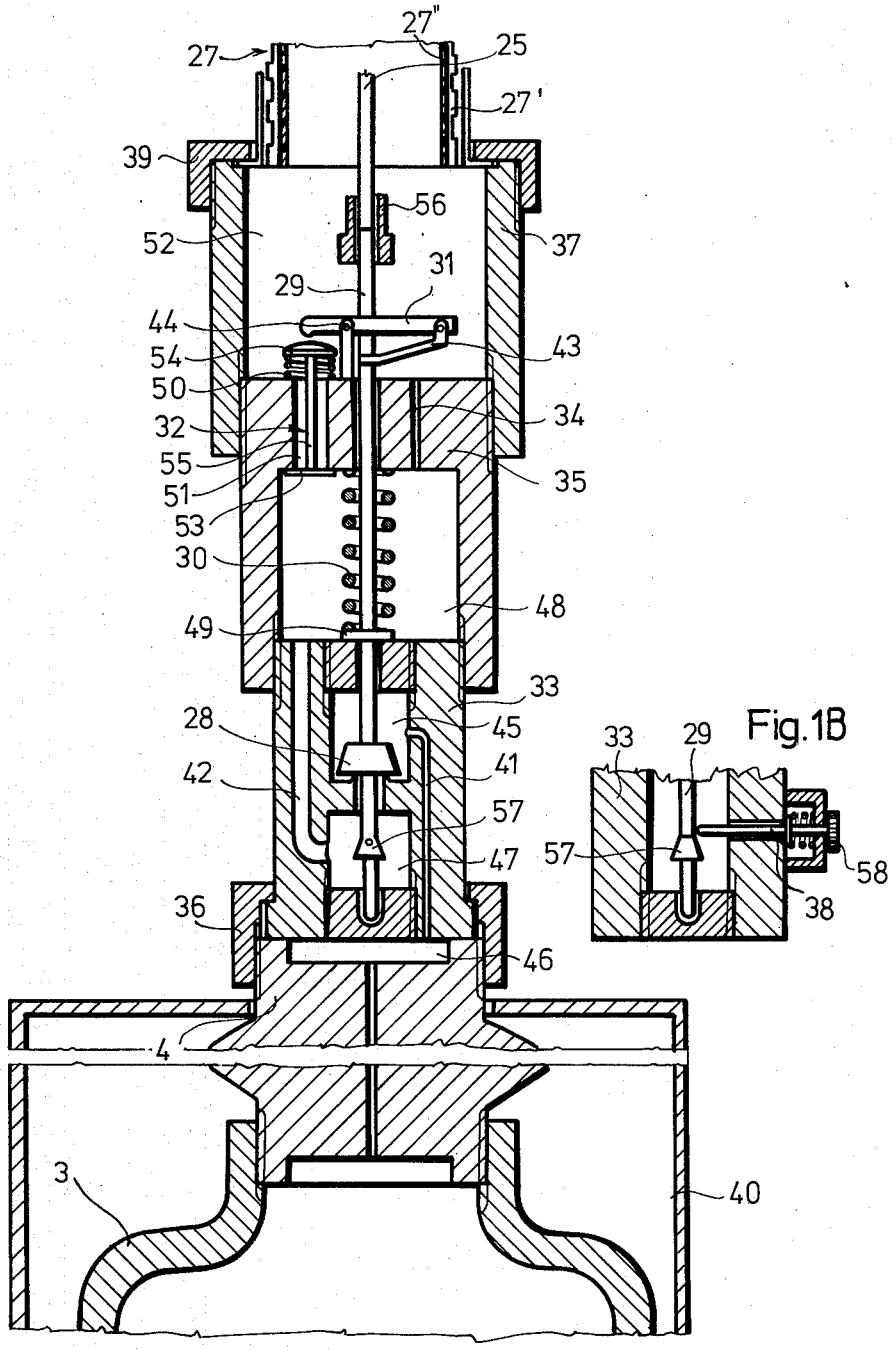
FIG. 1A is a cross-sectional view of a valve assembly according to our present invention, attached to an oxygen-containing vessel for regulating gas flow therefrom.
FIG. 1B is a cross-sectional view of a detail of the valve assembly of FIG. 1A, showing a latch mechanism.

As shown in FIG. 1A, an oxygen-containing pressure vessel 3 is mounted in a casing 40 attachable to a user's belt and is provided with a manually operated safety valve 4. According to our present invention, this valve is connected via a nut 36 to a valve housing 33 having a first chamber 45 communicating via a conduit 41 with a space 46 formed at the end of valve 4. A shaft 29 traversing chamber 45 bears a valve member 28 governing gas access to a second chamber 47 in housing 33, this chamber being connected via a conduit 42 to yet another chamber 48 formed in a spring housing 35 screwed onto valve housing 33.

A biasing spring 30 is compressed between an inside wall of housing 35 and an annular disk 49 rigid with shaft 29, biasing spring 30 tending to shift valve member 28 into a seated position which closes access to chamber 47 from chamber 45.

A collar 37 is screwed onto spring housing 35 and surrounds a valve-actuating assembly including a first lever 31 pivotably mounted on a post 44 rigid with housing 35 and a second lever 43 fixed at one end to shaft 29 and hingedly secured at an opposite end to lever 31. Levers 31 and 43 cooperate to actuate a spring-loaded valve 32 biased by a spring 50 to block a broad duct 51 extending from spring chamber 48 to the space 52 defined by collar 37. Valve 32 comprises a valve member 53 disposed in spring chamber 48, a lever-engaging plate 54 disposed in space 52 and a rod 55 interconnecting member 53 and plate 54. A narrow duct 34 extends from chamber 48 to space 52 parallel to broad duct 51.

Shaft 29 is attached within space 52 to a tension cable or rope 25 by means of a clamp 56, while collar 37 is joined by a nut 39 to a flexible hose 27 which may include an outer sheath 27′ of protective metal links and an inner plastic layer 27″.

As illustrated in FIGS. 1A and 1B, shaft 29 is formed with a substantially cone-shaped projection 57 which cooperates with a spring-loaded latch or pin 38 to maintain valve member 28 in an unseated or valve-open position against the action of spring 30. Pin 38 is provided with a knob 58 disposed outside valve housing 33.

Figure 2B:
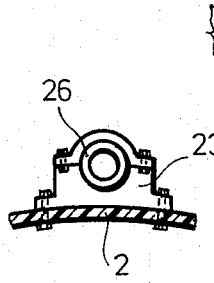
FIG. 2B is a partial cross-sectional view illustrating the attachment to a helmet of the conduit assembly of FIG. 2A.
Figure 2A:
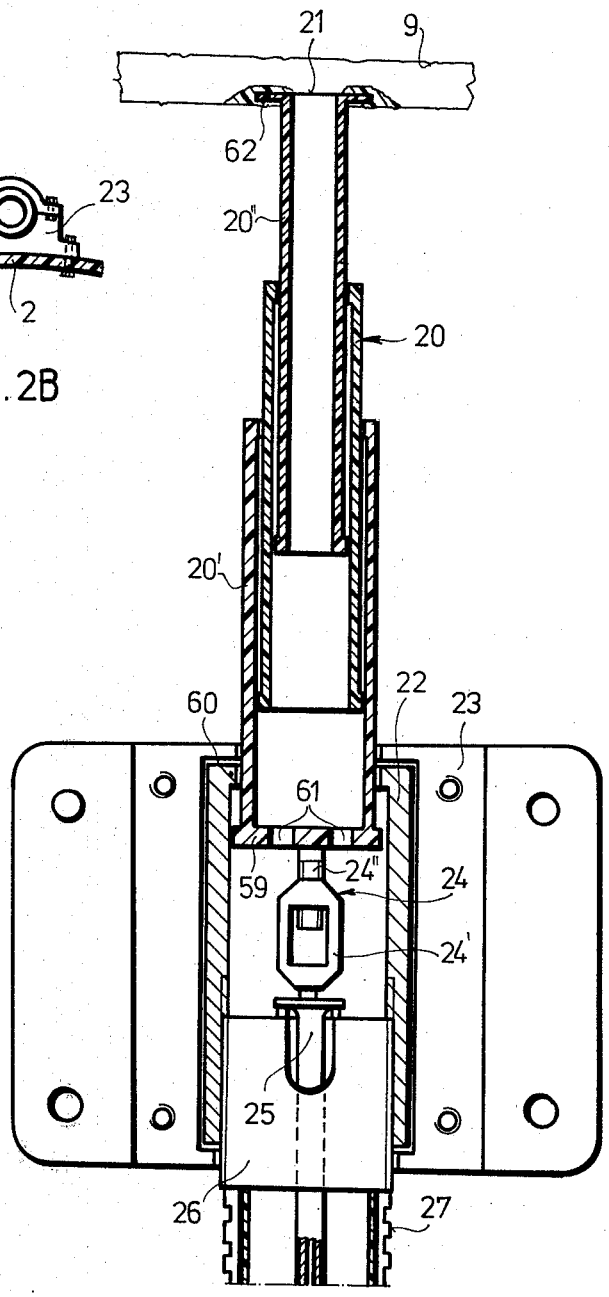
FIG. 2A is a cross-sectional view of a conduit assembly connected to the valve assembly of FIGS. 1A and 1B for channeling oxygen-containing gas therefrom.

As indicated in FIG. 2A, hose 27 is attached at an end opposite collar 37 to a cylindrical connector 26 in turn screwed to a sleeve 22. This sleeve is carried in a casing 23 mountable on a helmet 2 by means of bolts (FIG. 2B).

At an end opposite shaft 29 cable 25 is connected via a length-adjusting element 24 to a telescoping tube 20 which has a largest or outermost piece 20′ slidably mounted in sleeve 22. Piece 20′ has at one end a transverse closure plate 59 projecting beyond a cylindrical outer surface of piece 20′ to form an arresting flange. This flange is engageable with an inwardly extending edge 60 of sleeve 22 to limit an outward stroke of piece 20′. Plate 20′ is provided with apertures 61 enabling hose 27 to communicate with tube 59 via connector 26 and sleeve 22.

Adjusting element 24 is in the form of a bracket 24′ pivotably attached to cable 25 for rotation about a longitudinal axis and threadingly secured to a bolt 24″ which is fixed to end plate 59.

Figure 3:
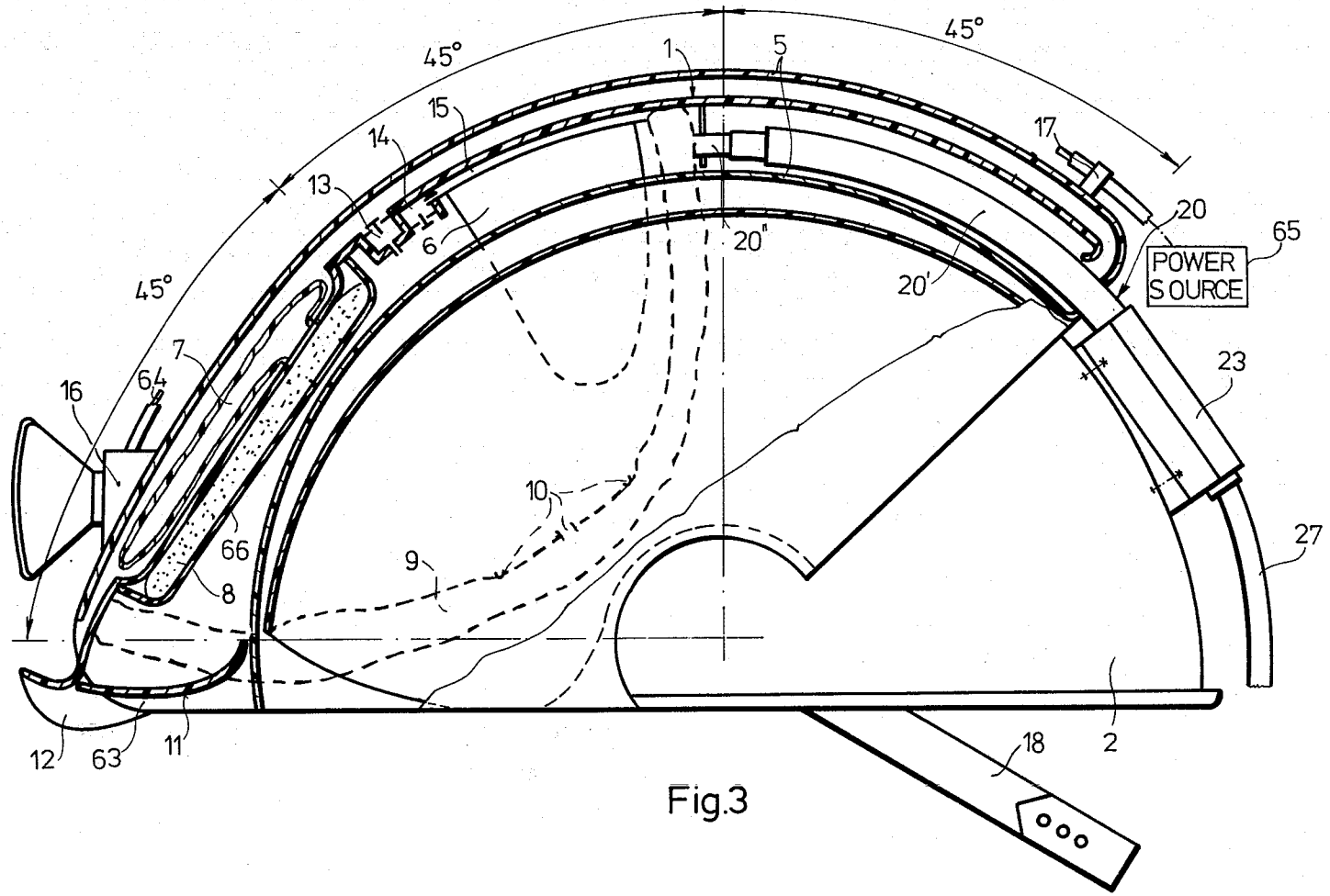
FIG. 3 is a partially cross-sectional side view of a helmet carrying a visor according to our present invention, the visor being connected to the conduit assembly of FIG. 2A and including a gas filter.
Figure 6:
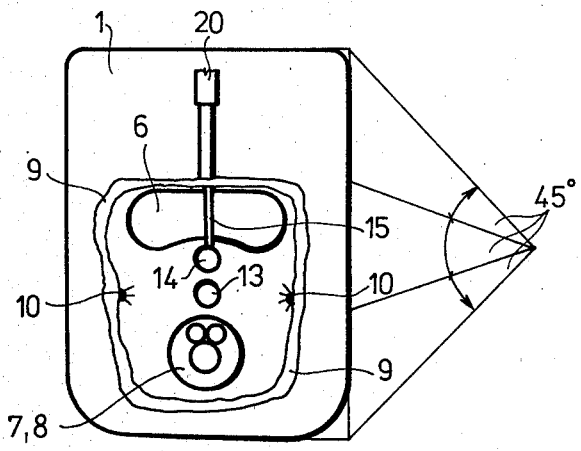
FIG. 6 is a rear elevational view of the visor of FIG. 3.

As illustrated in FIGS. 2A, 3 and 6, tube 20 has a smallest or innermost piece 20″ with an annular flange 62 imbedded in a sealing pad 9 secured to the inside surface of a visor 1 which is pivotably mounted on helmet 2 for swinging from an out-of-use position shown in FIG. 3 to an in-use position over the face of a user. Pad 9 extends substantially around a periphery of visor 1 for engaging the face of the user in an air-tight fit to form an enclosed space at the user's face.

Figure 4:
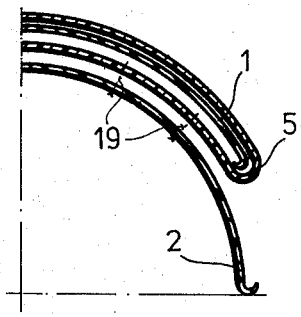
FIG. 4 is a partial cross-sectional view of the helmet of FIG. 3.

As shown in FIGS. 3 and 4, visor 1 is inserted in its out-of-use position between an inner layer and an outer layer of a protective shell 5 clamped to helmet 2 by means of spacer bolts 19. Shell 5 is traversed by telescope piece 20' at an enclosed rearwardly facing end and is formed at a forwardly facing end with an opening or mouth 63 for the emergence of visor 1, this mouth being bridged in an out-of-use state of the breathing or oxygen-supplying apparatus by a flexible flap 11 attached at one edge to visor 1 and forming at other edges a dust-tight engagement with shell 5. This shell carries a forwardly facing lamp or light 16 whose energization cable 64 extends rearwardly over shell 5 to an electric-power source 65 attachable, for example, to a belt worn by a user. A mounting bracket 17 on shell 5 holds cable 64 at a back end of helmet 2 (FIG. 3).

As illustrated in FIGS. 3 and 6, visor 1 is provided with an elongate transparency 6 which is juxtaposed to the eyes of the user in the in-use position of the visor to facilitate vision. Below transparency or window 6 in the in-use position of the visor is formed a pair of valves 13 and 14 for controlling the pressure of gases admitted into the enclosed space over the face of the user. Valve 14 is a pressure-relief valve connected to telescoping tube 20 via sealing pad 9 and a conduit 15 extending therefrom substantially in a vertical direction (in the in-use state of visor 1) longitudinally over the nose of the user. Valve 14 is advantageously a spring-loaded valve which opens upon the attainment of a predetermined pressure difference between the gases in tube 20 and the gases in the enclosed space defined by visor 1, pad 9 and the face of the user.

Valve 13 is preferably analogous in construction to valve 14 and opens the above-mentioned enclosed space to the atmosphere for venting thereto excess gas upon the exceeding of a pre-established pressure difference between the atmosphere and the gases in the enclosed space at the user's face.

As best seen in FIG. 3, a gas filter 8 preferably of the lime-bearing type is carried in a casing 66 integrally formed with visor 1, this filter communicating on one side with an air-storage sack 7 and on another side with the enclosed space over the user's face (in-use position of visor). Sack 7 is advantageously provided with a protective cover plate (not shown) mounted on visor 1.

Pad 9 may be hollow in a central upper region (see FIG. 6) for facilitating an initial high-volume air flow from tube 20 to conduit 15, as described more fully hereinafter, and is generally of an open-cell foam construction which permits a low-volume air flow from a mouth 21 (FIG. 2A) of innermost telescope tube 20'' to a multiplicity of spaced apertures 10 around an inwardly facing surface of sealing pad 9.

As indicated in FIG. 3 or 6 by three double-headed curved arrows, air-storage sack 7 and gas filter 8 are disposed in a first visor area or portion having an angular extension of 45°, valves 13, 14 and window 6 are disposed in a second 45° visor portion and telescoping tube 20 is disposed in a third 45° area in an out-of-use state of a breathing apparatus according to our present invention. Upon a shifting of visor 1 into the in-use position, telescoping tube 20 becomes extended over an approximately 135° angle through substantially the entire length of shell 5. The out-of-use and in-use positions of visor 1 are thus separated by about 90°.

The shifting of visor 1 into the in-use position is accomplished by means of a handle or grip 12 (FIG. 3) which may take the form of a loop attached to the forward edge of visor 1. Helmet 2 is held on the head of a user at least partially with the assistance of a strap 18 looped in a substantially U-shaped curve around a lower back portion of the user's head.

Because a breathing or oxygen-supplying apparatus according to our present invention is continually worn at danger sites by a user, the apparatus may be put into operation practically immediately upon the perception of a life-threatening condition in the air at a site. Such a condition may be an oxygen depletion due to a fire or to a voluminous incursion of foreign gases. Or there may be a leakage of poisonous vapors into the work area.

Upon the perception of such threat to normal breathing processes, visor 1 is pulled into the in-use position via a manipulation of grip or handle 12, telescoping tube 20 simultaneously extended from a collapsed configuration shown in FIGS. 2A and 3 to a maximally withdrawn configuration defined or signaled by the stroke-arresting engagement of the flange of plate 59 and the inwardly projecting edge 60 of sleeve 22.

Upon the beginning of an outward stroke of outermost telescope piece 20', a traction or tensile force is transmitted via element 24 and cable 25 to valve shaft 29. The consequent shifting of shaft 29 unseats valve member 28 and pivots lever 31 about point of attachment to post 44. The unseating of member 28 enables oxygen-containing gas, e.g. air, to flow from chamber 45 through conduit 42 to spring-housing chamber 48, chamber 45 being precharged with air by the opening of safety valve 4 upon the arrival of the user at a work site or other location bearing a threat to normal breathing.

The pivoting of lever 31 upon an initial valve-opening shift of rod or shaft 29 results in an unseating of valve member 53 in opposition to the action of biasing spring 50. Air from chamber 48 is thereby enabled to flow through broad duct 51, as well as through narrow duct 34, into space 52 and from thence into the aforementioned enclosed space over the user's face via hose 27, sleeve 22, tube 20, pad 9, conduit 15 and valve 14. This initial stream of air has a flow rate of 80–90 liters per minute and a duration of one or two seconds, whereby the supply of oxygen to the user occurs practically simultaneously with the positioning of the visor.

Upon the initial shifting of rod 29, pin 38 moves outwardly owing to a camming engagement with cone-shaped projection 57 and then suddenly inwardly upon the completed passage of this projection. A subsequent release of handle 12 by the user enables biasing spring 30 to reverse the motion of rod 29, whereby pin 38 engages a transverse surface of projection 57 to form a lock preventing any further motion of the valve rod or shaft 29. The lock of pin 38 and projection 57 maintains valve member 28 at a distance from its seat in chamber 45, thereby preserving an air-flow path or channel extending from vessel 3 to visor 1.

The reversal in the direction of motion of rod 29 upon the release of manual grip 12 induces lever 43 to pivot lever 31 away from valve plate 54, whereby valve member 53 shifts to block duct 51. This closing of the broad duct terminates a transient beginning phase involving an initial charging of the enclosed face space. In an ensuing steady-state phase air flows at a rate of approximately two liters per second, this rate being primarily determined by the transverse dimensions of narrow duct 34.

Figure 5:
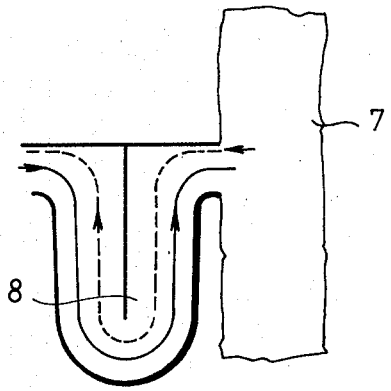
FIG. 5 is a diagram illustrating air or gas flow to and from the filter of FIG. 3.

As schematically illustrated in FIG. 5, air flows from the enclosed face space to the storage sack 7 (solid line) where noxious gases such as carbon dioxide are removed through contact with filter 8, the purified air returning to the enclosed space (dashed line). The use of the filter and the storage sack increases the time that endangered personnel have to escape the site of the contaminated atmosphere by making more efficient use of the oxygen available from vessel 3. It is, however, feasible to omit sack 7 and filter 8 and to adjust pressure-relief valves 13 and 14 to open upon exhalation and inhalation of the user, respectively. It is also possible in some cases to use a visor 1 which is not sealed to the face of the user via a pad 9 and which does not have the pressure-relief valves 13, 14. The stream of air from vessel 3 is then adapted to have a flow rate of a magnitude to prevent the incursion of noxious fumes from the atmosphere into a partially enclosed space at the face of the user.

Upon the emergence of personnel from the dangerous area, pin 38 may be pulled outwardly via a manipulation of knob 58, whereby biasing spring 30 reseats valve member 28. Visor 1 is then pivoted or inserted into the storage space between the upper and lower layers of protective shell 5.

Bracket 24' (FIG. 2A) may be rotated about bolt 24" to adjust the effective length of a force-transmitting member including cable 25. Such a length adjustment enables the user to ensure a proper length of the outward or valve-opening stroke of rod 29. This stroke must be long enough to guarantee a locking of pin 38 and projection 57 but should not be so long as to damage valve actuating assembly 31, 43, 44.

We claim:

1. An apparatus for supplying oxygen to a user, said apparatus comprising:

a helmet;

a visor shiftably mounted on said helmet for normally assuming an out-of-use position and for assuming an in-use position over the face of said user upon manipulation thereby;

an oxygen-containing vessel attachable to a belt worn by said user;

conduit means connected at one end to said vessel and at another end to said visor for forming a gas-guiding channel between said vessel and a space formed between the face of said user and said visor upon a shifting thereof into said in-use position;

gas-flow control means on said vessel for enabling communication between said vessel and said conduit means, said gas-flow control means including first means for conveying oxygen-containing gas from said vessel to said enclosed space at a relatively slow rate during a substantially steady-state operation of said apparatus and second means for conveying gas from said vessel to said enclosed space at a relatively high rate during a transient state involving an initial charging of said enclosed space upon a shifting of said visor into said in-use position; and force-transmitting means extending from said visor to said gas-flow control means for actuating same to connect said vessel to said conduit means upon a shifting of said visor into said in-use position.

2. An apparatus for supplying oxygen to a user, said apparatus comprising:

a helment;

a visor shiftably mounted on said helment for normally assuming an out-of-use position and for assuming an in-use position over the face of said user upon manipulation thereby;

an oxygen-containing vessel attachable to a belt worn by said user;

conduit means connected at one end to said vessel and at another end to said visor for forming a gas-guiding channel between said vessel and a space formed between the face of said user and said visor upon a shifting thereof into said in-use position;

a gas-flow control means on said vessel for enabling communication between said vessel and said conduit means;

force-transmitting means extending from said visor to said gas-flow control means for actuating same to connect said vessel to said conduit means upon a shifting of said visor into said in-use position;

closure means including a seal on said visor for engaging in a substantially air-tight fit the face of said user upon a shifting of said visor into said in-use position, whereby an enclosed space is formed at the face of said user; and pressure regulating means on said visor for controlling the pressure of gas admitted into said enclosed space from said vessel via said conduit means.

3. The apparatus defined in claim 2 wherein said pressure-regulating means includes a first pressure-relief valve connected to said conduit means for admitting oxygen-containing gas into said enclosed space upon the exceeding of a predetermined limit by the pressure difference between gas in said conduit means and gas in said enclosed space, said pressure-regulating means further comprising a second pressure-relief valve disposed on said visor between the atmosphere and said enclosed space for venting excess gas therefrom.

4. An apparatus for supplying oxygen to a user, said apparatus comprising:

a helmet;

a visor shiftably mounted on said helmet for normally assuming an out-of-use position and for assuming an in-use position over the face of said user upon manipulation thereby;

an oxygen-containing vessel attachable to a belt worn by said user;

conduit means connected at one end to said vessel and at another end to said visor for forming a gas-guiding channel between said vessel and a space formed between the face of said user and said visor upon a shifting thereof into said in-use position;

gas-flow control means on said vessel for enabling communication between said vessel and said conduit means;

force-transmitting means extending from said visor to said gas-flow control means for actuating same to connect said vessel to said conduit means upon a shifting of said visor into said in-use position;

closure means including a seal on said visor for engaging in a substantially air-tight fit the face of said user upon a shifting of said visor into said in-use position, whereby an enclosed space is formed at the face of said user;

pressure regulating means on said visor for controlling the pressure of gas admitted into said enclosed space from said vessel via said conduit means, said pressure-regulating means including a first pressure-relief valve connected to said conduit means for admitting oxygen-containing gas into said enclosed space upon the exceeding of a predetermined limit by the pressure difference between gas in said conduit means and gas in said enclosed space, and a second pressure-relief valve disposed on said visor between the atmosphere and said enclosed space for venting excess gas therefrom; and a sack linked to said visor for communicating with said enclosed space to receive and temporarily store gas therefrom, said sack being connected to a device for eliminating noxious components from the gases in said enclosed space.

5. The apparatus defined in claim 4, wherein said conduit means includes a flexible hose attached to said vessel via said gas-flow control means, further comprising mounting means on said helmet for securing said hose thereto, said conduit means further including a telescoping tube extending from said mounting means to said visor.

6. The apparatus defined in claim 5 wherein said force-transmitting means includes a tension member extending through said hose along the length thereof.

7. The apparatus defined in claim 6 wherein said force-transmitting means includes means for adjusting the effective length of said tension member.

8. The apparatus defined in claim 1, 2, 3, 4, 5, 6 or 7, further comprising a protective shell mounted on said helmet, said visor being inserted between said shell and said helment in said out-of-use position.

9. The apparatus defined in claim 1 wherein said first means includes a narrow gas-conducting duct and said second means includes a broad gas-conducting duct, said gas-flow control means further including an initialization valve normally blocking said broad duct and actuator means operatively connectable to said initialization valve for temporarily unblocking said broad duct upon a shifting of said visor into said in-use position.

10. The apparatus defined in claim 9 wherein said gas-flow control means includes a shaft connected to said tension member and said actuator means includes a pivotably mounted lever linked to said shaft for swinging into an engagement with said initialization valve upon a loading of said tension member.

11. The apparatus defined in claim 10 wherein said gas-flow control means includes a valve member rigid with said shaft and seated in a valve housing in an out-of-use state of said apparatus corresponding to said out-of-use position, said gas-flow control means further including a spring-loaded latch mounted in said housing, said shaft being biased by a spring in a direction tending to seat said valve member in said housing, said shaft being provided with means for forming a locked engagement with said latch in an in-use state of said apparatus corresponding to said in-use position.

* * * * *